United States Patent [19]

Hisazumi et al.

[11] 4,275,544

[45] Jun. 30, 1981

[54] VACUUM PACKAGING METHOD

[75] Inventors: Nobuyuki Hisazumi; Masataka Yamamoto; Tsutomu Uehara, all of Iwaki, Japan

[73] Assignee: Kureha Kagaku Kogyo Kabushiki Kaisha, Tokyo, Japan

[21] Appl. No.: 74,828

[22] Filed: Sep. 12, 1979

Related U.S. Application Data

[63] Continuation-in-part of Ser. No. 936,696, Aug. 25, 1978.

[30] Foreign Application Priority Data

| | | | |
|---|---|---|---|
| Sep. 5, 1977 | [JP] | Japan | 52-105787 |
| Aug. 30, 1978 | [NL] | Netherlands | 7808910 |
| Sep. 1, 1978 | [CA] | Canada | 310483 |
| Sep. 1, 1978 | [DE] | Fed. Rep. of Germany | 2838226 |
| Sep. 5, 1978 | [BE] | Belgium | 190251 |
| Sep. 5, 1978 | [FR] | France | 78 25556 |
| Sep. 5, 1978 | [IT] | Italy | 27316 A/78 |
| Sep. 5, 1978 | [GB] | United Kingdom | 35664/78 |

[51] Int. Cl.[3] ..... B65B 31/02; B65B 11/52

[52] U.S. Cl. ..... 53/433; 53/427

[58] Field of Search ..... 53/427, 433, 511

[56] References Cited

U.S. PATENT DOCUMENTS

| | | | |
|---|---|---|---|
| Re. 30,009 | 5/1979 | Perdue et al. | 53/433 |
| 3,663,240 | 5/1972 | Seiferth et al. . | |
| 4,164,109 | 8/1979 | DuBois | 53/511 X |

FOREIGN PATENT DOCUMENTS

| | | |
|---|---|---|
| 2079331 | 11/1971 | France . |
| 2141043 | 1/1973 | France . |
| 2183932 | 12/1973 | France . |
| 2282371 | 3/1976 | France . |
| 2310935 | 12/1976 | France . |

*Primary Examiner*—Travis S. McGehee

*Attorney, Agent, or Firm*—Wegner & Bretschneider

[57] ABSTRACT

An improved method of vacuum packaging by using a specific laminated film as a package film, the laminated film being composed of a plastically deformable layer of a synthetic resin having a yield stress more than 50 kg/cm$^2$ at a temperature of 23° C. and an elongation of less than 30% at elastic limit at a shaping temperature of 50° to 180° C. and an elastic layer of a synthetic resin having an elongation of more than 40% at elastic limit at the shaping temperature.

14 Claims, 6 Drawing Figures

FIG. 1 Vacuum Packaging Apparatus

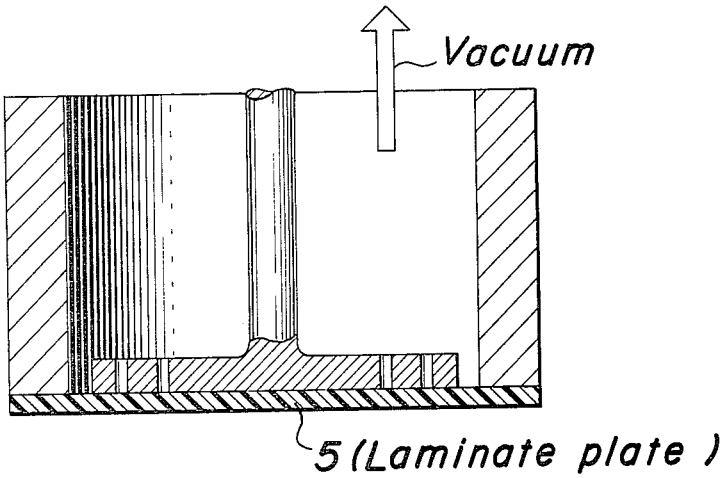
FIG.2
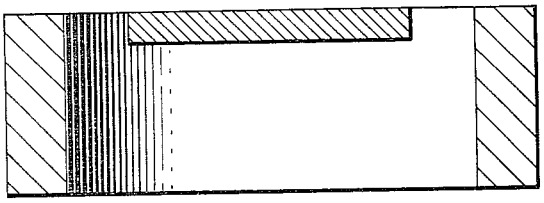
Step (a)
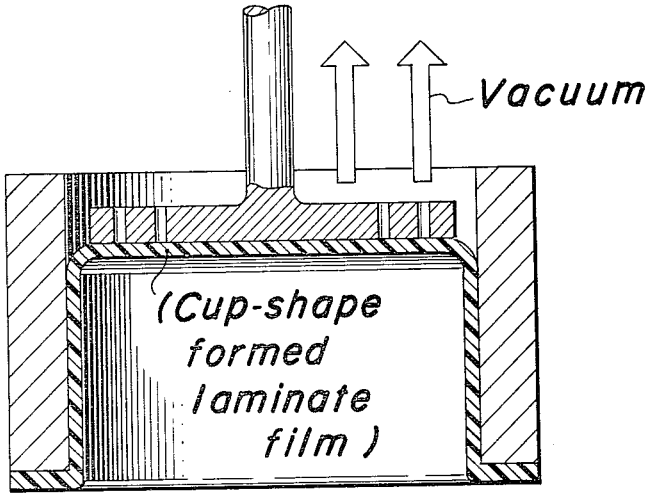
FIG.3
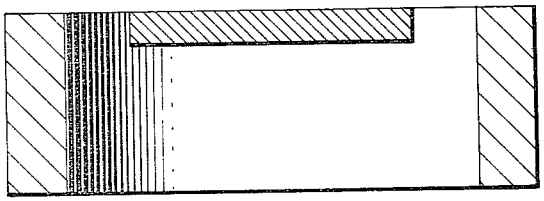

VACUUM PACKAGING METHOD

CROSS-REFERENCE TO RELATED APPLICATION

The present application is a continuation-in-part of application Ser. No. 936,696, filed Aug. 25, 1978, and entitled "VACUUM PACKAGING METHOD".

BACKGROUND OF THE INVENTION

The present invention relates to an improvement in vacuum packaging.

In recent years, the blister-packaging technique using metal molds has been widely used. As is well known, the blister-package is feasible by a method in which a sheet or film is at first shaped in a desired form of container by means of a metal mold and, after charging a material or an article to be packed into the cup of the shaped sheet or film and combining with a flat base film or sheet provided with a plurality of small holes for the passage of air, the container is tightly sealed while containing the material or the article therein after replacement of air in the cup-shaped container made by the shaped film and the flat base film or sheet or after evacuation of the container through the holes provided in the flat base film or sheet, the holes being sealed afterwards automatically by the melt sheet. When the close-fit packaging is applied to perishables such as meat, the space inevitably established between the material or the article and the film promotes juice separation, thus spoiling the appearance and causing putrefaction of the packaged material. In order to overcome the above-mentioned disadvantage, there have been proposed several methods including a method in which the size of metal mold is closely coincided with the outer dimensions of the material or article to be packaged, and a method in which the degree of vacuum in the shaped sheet is made so high that the packaging film is forced to be tightly contacted with the material or the article to be packed along its external form. However, the former method is not practical since it is necessary to have a rigorous control of the size of materials or articles to be packed and the insertion of such material or article into the thus formed container is not easy. While, the latter method is disadvantageous in that an excess portion of film is undesirably wrinkled on evacuation and the packaged material or article becomes irregular in shape, thus producing a poor external appearance. In addition, the wrapping film is apt to be broken in the portions folded and wrinkled. Both methods are thus unfavorable from a practical point of view. There is accordingly a strong demand for improvements in the packaging films and methods.

In order to realize a tight package while avoiding the wrinkles occurring in surplus portions of the film, there has been also proposed use of heat shrinkable or elastic films as packaging film. In this connection, however, usual stretched films or elastic films are practically unsatisfactory because of their large residual stress or strain. For example, the stretched film or the elastic film often warps the article or material itself which is packaged therewith or squeezes a soft material or such as ham, sausage or the like, or causes separation at the seal.

As an attempt to give vacuum-tight packages with reduced residual stress, there is disclosed in Japanese Laid-Open Application No. 48-6891 a packaging method utilizing the specific thermal property of film of vinylidene chloride copolymer. In this method, the vinylidene chloride copolymer is extruded in the form of a film and is immediately quenched rapidly to keep the film in an amorphous state, and this film is used for packaging. More precisely, the use of such a film is advantageous in that the film in the amorphous state can be prevented from becoming wrinkled on packaging due to its inherent elasticity and that, after packaging, the wrapped film can be fixed in shape by crystallization thereof and by freezing the strain thereof. In this method, the adverse effect due to the residual stress or the strain as experienced in ordinary shrinkable or elastic films can be avoided.

In this method, however, as it is necessary that the film of vinylidene chloride copolymer formed by extrusion be immediately quenched rapidly to retain amorphous state prior to use. The film-forming step and the packaging step are directly connected so as to complete the packaging procedure within a very short time before crystallization of the rapidly cooled copolymer is induced, and the film is crystallized in a subsequent step such as by heat treatment. Accordingly, this method has the vital disadvantage that if the speeds in related steps, particularly the film-forming speed and the packaging speed, are not synchronized properly, the packaging will become impossible, entailing a loss of materials. Further, owing to the inherent characteristics of the copolymer of vinylidene chloride, the packaging procedure should be carried out at a sufficiently low temperature to avoid crystallization of the film which is remarkably accelerated under high temperature conditions resulting in a loss of elasticity. This poses a serious problem if bacteria remain on the film which is used to wrap raw ham, perishable and the like foods, for which the sterilization at high temperature must be avoided after once packed.

SUMMARY OF THE INVENTION

It is therefore a main object of the present invention to provide a laminated film which can overcome the disadvantages of the prior art and which is free from residual stress or strain and is suitable for tightly packaging the materials along their profile, and also to provide an improved thermal and vacuum packaging method using such a laminated film.

According to the present invention, this and other objects can be achieved by a vacuum packaging method which comprises using as a packaging film a laminated film comprising a plastically deformable layer of a synthetic resin having a yield stress more than 50 kg/cm$^2$ at a temperature of 23° C. and an elongation of less than 30% at an elastic limit at a shaping temperature of 50° to 180° C., and an elastic layer of a synthetic resin having an elongation of more than 40% at elastic limit at the shaping temperature.

The resins which are utilized as the plastically deformable layer in the laminated film and which are hardly deformed plastically at a temperature of 23° C. but are plastically deformable at a shaping temperature should have a yield stress more than 50 kg/cm$^2$ and less than 1,000 kg/cm$^2$ at a temperature of 23° C., preferably less than 500 kg/cm$^2$ at the shaping temperature and an elongation of less than 30%, preferably less than 25% at the elastic limit, i.e., the resin flows or is permanently deformed under a stress deformation of about 30%. In other words, the resin is of the type which is easily deformed plastically by melting at the shaping temperature or under a stress less than $\frac{1}{3}$, preferably less than 1/5 of the yield stress at a temperature of 23° C. and most preferably under a stress below 10 kg/cm$^2$ at the shaping temperature even though not melted at the shaping temperature.

It will be noted that the term "elastic limit" used herein is defined as a stress at an elastic recovery rate of 95% when a specimen with an effective length of 100 mm is pulled at a tensile velocity of 500 mm/min and immediately the stress exerted on the specimen is released. The term "plastic deformation" is sometimes used, in a broad sense, to mean not only plastic deformation, but also deformation due to viscous flow, and herein is used to cover such a broad interpretation.

More concrete examples of the resin include homopolymers of α-olefins such as ethylene, propylene and the like, copolymers with a major proportion of the α-olefins and a minor proportion of monomers copolymerizable with such α-olefins, ionomers of copolymers of α-olefins and organic acids, vinylidene chloride-base resins, saponified ethylene-vinyl acetate copolymers, acrylonitrile-base resins, and the like. These resins may be used singly or in combination. The plastically deformable layer may be made of a laminate of the films obtained from the different resins indicated above.

Of the above-mentioned resins, the vinylidene chloride-base resins, saponified ethylene-vinyl acetate copolymers, and acrylonitrile-base resins are preferable particularly in cases where a high impermeability to gases is required since they are all high in impermeability to gases. The vinylidene chloride-base resins are those which comprise a major proportion of vinylidene chloride and a minor proportion of monomers copolymerizable therewith. Preferably monomers are, for example, vinyl chloride, acrylonitrile, organic acids such as acrylic acid, methacrylic acid, maleic acid, itaconic acid, etc., alkyl esters of these organic acids, vinyl acetate, isobutylene, butadiene, and the like. In general, 60 to 95 parts by weight of vinylidene chloride is copolymerized with 40 to 5 parts by weight of the one or more copolymerizable monomers. As a matter of course, these copolymers may be mixed with less than 10 wt % of additives such as harmless plasticizers, stabilizers and the like.

The saponified products of ethylene-vinyl acetate copolymer are those composed of 20–50 mole % of ethylene and 50–80 mole % of vinly acetate and saponfied to an extent of at least 96% or more.

The acrylonitrile-base resins are those which comprises a major proportion of acrylonitrile copolymerized (or graft-copolymerized) with a minor proportion of copolymerizable monomers such as, for example, butadiene, styrene, acrylic esters, methacrylic esters and the like.

These copolymers of high impermeability to gases may be mixed with minor proportions of butadiene copolymers or acrylic esters to improve their impact strength.

However, these resins with high impermeability to gases are generally in a crystalline state and rapidly increase their fluidity at melting point at which they turn fluid. Since the yield stress of a layer of such resin at temperatures below the melting point is lowered only slightly with rise in temperature, it is preferable that this resin layer is used in combination with a layer of a resin which has a low softening point and can thus lower the yield stress of the laminate less than 5 kg/cm$^2$ at the shaping temperature, or preferably with a layer of a resin which provides viscous flow at the shaping temperature in order to provide a large difference between the yield stresses at a temperature of 23° C. and at the shaping temperature.

The layer of a resin of lower softening temperature should preferably show an adhesiveness at the shaping temperature onto at least the one surface contacting a base film.

On the other hand, the resins showing a rubber-elasticity which are used as the elastic layer of the laminated film according to the present invention are those which show an elongation of more than 40% at elastic limit at the shaping temperature. Examples of such resins include homopolymers of butadiene or isoprene, random or block copolymers such as of butadiene or isoprene with styrene and acrylonitrile, etc., ethylene-propylene copolymer, chlorinated polyethylene, plasticized polyvinyl chloride, stretched and oriented vinylidene chloride-base resins, stretched and oriented products of saponified ethylene-vinyl acetate copolymer, and the like, preferably plasticized polyvinyl chloride and 1,2-polybutadiene.

It will be noted that the terms "plastically deformable resin" and "elastic resin" are used to distinguish the two only at the shaping temperature for convenience sake. For instance, resins such as butadiene-styrene copolymers serving as an elastomer at a temperature of 23° C. are plastically deformed at elevated temperatures if not cross-linked. Thus, it may be possible that the laminated film be constructed, if desired, of a plastically deformable layer composed of a non-cross-linked butadiene-styrene copolymer layer and a vinylidene chloride resin layer and of a cross-linked butadiene-styrene copolymer layer as an elastic layer. In this sense, any resins other than the afore-indicated resins for the plastically deformable layer and the elastic layer which meet the afore-mentioned requirements may be likewise used.

The laminated film according to the present invention is, as described hereinbefore, constructed of two or more resin layers including at least one plastically deformable resin layer and at least one elastic resin layer. These laminated films can be made by usual methods such as co-extrusion, dry laminating or combinations thereof.

The vacuum packaging method of the present invention using the laminated film is feasible by a series of the following steps of: making cup-shaped hollows in the laminated film by means of a vacuum metal mold; placing materials or articles to be packed in positions of the spaces formed between the cup-shaped hollows and a flat base film or sheet which is placed on the laminated film and is provided with a plurality of small holes for the passage of air; bringing the flat edge part of the shaped laminate film into contact with the base film; evacuating the interior of the cups formed by the cup-shaped laminate film and the base film or sheet through the holes in the base film or sheet; and returning the pressure of spaces between the mold and the cup-shaped film from the vacuum to a normal pressure level, the temperature of the metal mold and the films being controlled for the necessary deformation and sealing during the above-mentioned steps, thereby ensuring the tight package.

The reason why a tight package is realized is as follows: As the pressure in the opposite sides of the shaped film approaches a vacuum, the shaped film starts to shrink by itself without wrinkles due to the elastic recovery force of the elastic layer until it tightly contacts the article or material placed in the cups. If the outermost layer directly contacting with the mold has a large friction coefficient with the metal mold surface, the film may be stretched at the cup-shaped part to an excess and, in an extreme case, broken. Needless to say, such trouble occurs less frequently as compared to the case where no elastic layer is used. In order to overcome this problem, however, it firstly occurs to change the shape of the mold. Several other methods may be used including a method in which a suitable temperature gradient is imparted to the mold upon the shape forming, a method in which a lubricant or air is introduced between the outermost layer and the mold, and a method using as the outermost layer a resin which is heat resistant and small in coefficient of friction. Most preferably, the laminated film used should have an elastic recovery rate, on shape forming, of more than 80%.

In order that the resin layer plastically deformed at the shaping temperature faithfully follows the deformation recovery of the elastic resin layer, it is preferable to impart adhesiveness to the plastically deformable resin layer or the elastic layer by any known method.

After the multi-laminated film has tightly wrapped around the material or article by the above-described method, the plastically deformable layer solidifies either naturally in case where the material is, for example, food cooled to low temperature or by cooling the material not yet cooled. As a result, the plastically deformable layer becomes so hard as to stand against the residual stress of the elastic resin layer, freeing the packaged material from a large compression force. Accordingly, even if soft materials or articles such as ham, sausage, etc., are packaged, they are free from being unduly deformed or being pressed to such an extent as to allow their juice to be squeezed out by an excessive compressing force exceeding that required only for the tight package. Further, even though the adhesion to the base film is to a degree mere vacuum adhesion, there is no fear of separation in the sealing portion due to the residual strain. The laminated film or packaging film after complete solidification of the plastically deformable layer is tough at temperatures below room temperature of 23° C. and is not deformed with ease. This is advantageous in that the packaged articles or materials are free from damage even when a number of the packaged articles or materials are packed in, for instance, a carton box for transport.

According to another aspect of the present invention, it is practically preferable to define the thicknesses of the individual layers of the laminated film within specific ranges, respectively, in order to produce the above-mentioned unique plasto-mechanical effects of the plastically deformable layer and the elastic layer under two different temperature conditions, i.e., the shaping temperature and room temperature.

The total thickness of the multi-laminated film is preferably in the range of 40–150$\mu$. A thickness smaller than 40$\mu$ is practically unsatisfactory in its physical strength, while, with larger thickness than 150$\mu$, such film undesirably requires a long heating time and is hard to deform. The plastically deformable resin layer or layers are preferred to have a thickness, in total, of 3–100$\mu$, more preferably of 10–50$\mu$. A thickness smaller than 3$\mu$ is unfavorable since the resistance of the layer to the residual stress of elastic layer after cooling becomes poor. A thickness exceeding 100$\mu$ is also unfavorable since such a film will impede the elastic recovery of the elastic layer, producing wrinkles and thus giving an objectionable appearance to the packaged material or article. The elastic layer or layers are preferably, in total, of 10 to 100$\mu$ in thickness. With the thickness of smaller than 10$\mu$, the elastic recovery of the elastic layer at the shaping temperature is impeded by the action of the other layer, tending to produce wrinkles on the package. An elastic layer with a thickness larger than 100$\mu$ retains a large residual stress after cooling, deforming the packaged material or the article or causing separation in sealing region.

The shaping temperature useful in the method of the present invention is in the range of 50°–180° C., preferably 60°–160° C. and most preferably 70°–150° C. A temperature lower than 50° C. is unfavorable since the form-stabilizing effect of the laminated film by the action of the plastically deformable resin layer becomes inadequate due to a small difference between the shaping temperature and the cooling temperature. While, with higher temperatures than 180° C., the film is superheated. This is not favorable since various troubles will develop, e.g., when precision instruments are packaged, they may be out of order, or when water-containing foods are packaged, the surface temperature of the food will exceed 100° C. even on instantaneous contact, thus generating steam thereby hindering vacuum tight contact with the food.

Adopting a shaping temperature above 60° C., preferably above 70° C. produces an advantage that the packaging film is naturally sterilized and is thus very good for sanitary purposes, so that it can be safely applied to materials such as ham which cannot be subjected to high temperature sterilization. Though the higher film temperature gives a greater sterilization effect, psychrophilic bacteria which do not bear spores are generally thermally killed at temperatures above 60°–70° C. Propagation of spores or bacteria other than the above-mentioned psychrophiles can be prevented by cold storage. Thus, the above-indicated shaping temperature conditions are satisfactory for the practice of the present invention.

Any film may be used as a base film in the practice of the present invention, including single-layer or multi-layer films or sheets made of known various plastics, metal foils or paper sheets, or laminates of these foils and sheets with plastic films or sheets. These materials may or may not be cup-shaped.

The multi-laminated film may be adhered to the base film by providing a known adhesive layer therebetween and treating under the vacuum heating conditions. Also it is possible to make the layer selected from the group of resins which deform plastically at the temperature of shaping as the outermost layer of the multi-layered film and to make the layer which thermally adheres to the afore-mentioned outermost layer as the outermost layer of the base film and then to have both opposing layers pressure-welded together under thermal and vacuum conditions or self-welded.

Especially when the resin for the both outermost layers is chosen from homopolymers of $\alpha$-olefins, copolymers of $\alpha$-olefins with vinyl acetate, and ionomers of copolymers of $\alpha$-olefins with methacrylic acid, or when a low melting point adhesive layer is provided on at least one side of the layers, the opposing outermost layers are readily self-welding at the shaping temperature without application of any mechanical pressure thereon and therefore provide a favorable combination. Examples of such adhesive melting at low temperature include vinyl acetate polymers, ethylene-vinyl acetate copolymers, ionomers of copolymers of $\alpha$-olefins and methacrylic acid, and various types of rubbers such as diene-base polymers, chlorinated polyethylene, etc., known low melting point resin compositions such as resin mixtures with rosin, etc, as tackifier or wax, hot-melt resins, and adhesive resins.

Other advantages and features of the present invention will become apparent from the following examples, which are described by way of illustration only.

BRIEF EXPLANATION OF DRAWINGS

FIG. 2 illustrates the first step in carrying out a process in accordance with the present invention.

FIG. 3 shows the cup-shaped hollows formed in layered film 5 as a result of step a.

DESCRIPTION OF A PREFERRED EMBODIMENT

Figure 1:
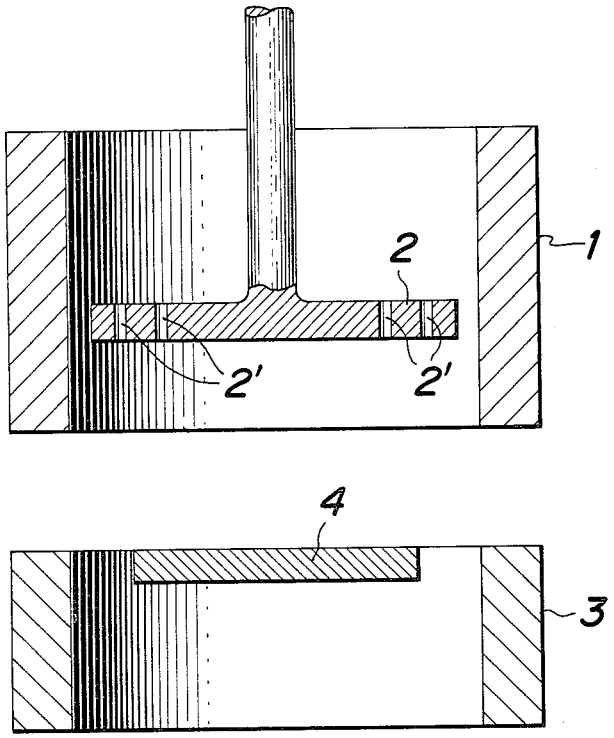
FIG. 1 is an illustration of vacuum packaging apparatus in accordance with one embodiment of the invention.
Figure 4:
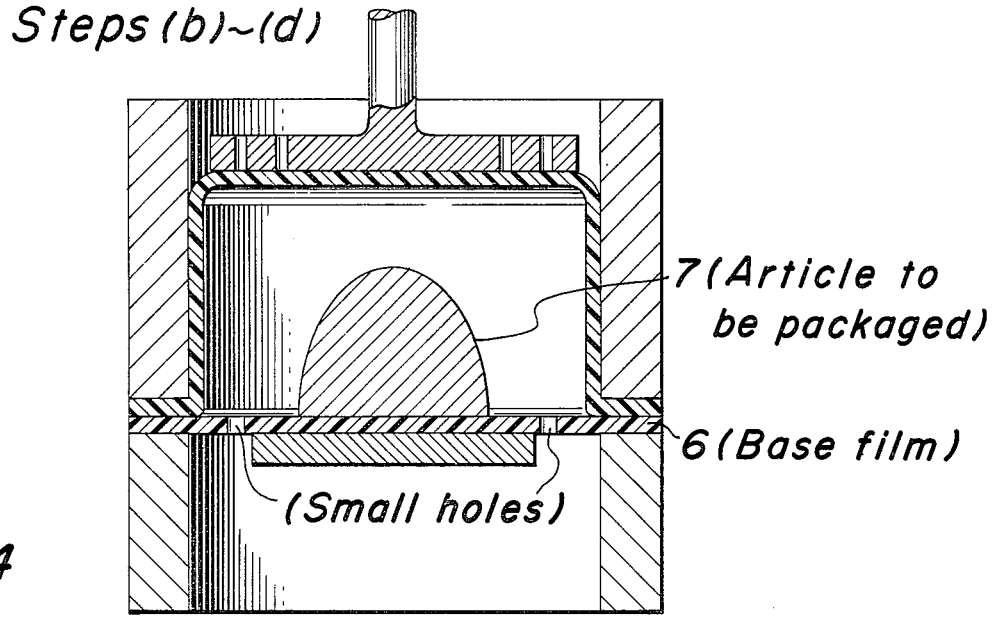
FIG. 4 illustrates the location of an article to be packaged in the cup-shaped hollows in accordance with the further steps of a process in accordance with the present invention.
Figure 5:
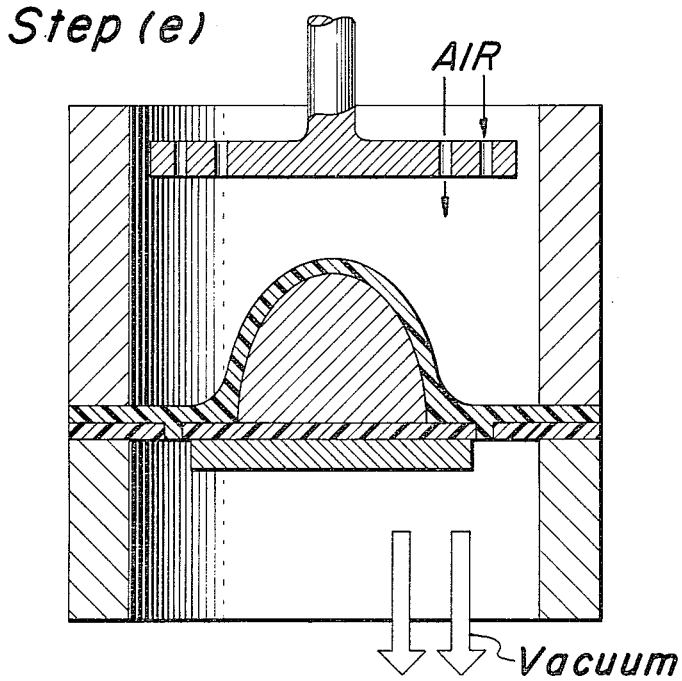
FIG. 5 illustrates the sealing of an article in a further processing step.
Figure 6:
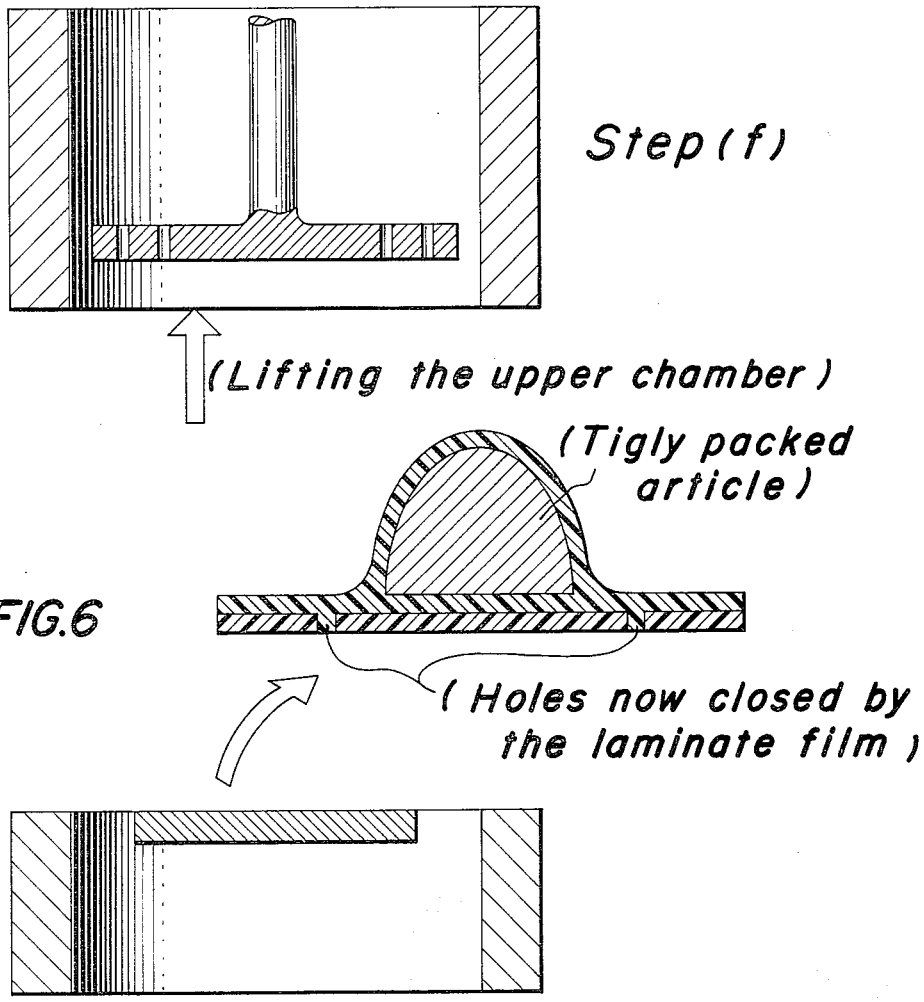
FIG. 6 illustrates the removal of a packaged article as the final step in a process in accordance with the present invention.

FIG. 1 is a diagrammatic illustration of the vacuum packaging procedures in a non-limiting type of an apparatus for the packaging showing cross sections of the metal molds consisting of the walls of vacuum chambers and the heat plates. In FIG. 1, 1 is the upper vacuum chamber provided with a movable (up and down) heat plate 2 having a plurality of small holes 2 for the passage of air, the wall of the chamber 1 and the heat plate 2 constituting a metal mold, and 3 is the lower vacuum chamber provided with a hot plate 4 also constituting a metal mold. The walls and the heat plate are thermally controlled by an electrical current.

EXAMPLE 1

A laminated film was prepared which was so designed as to have, from outside, first and second layers both of which were plastically deformable, and a third layer having a rubberlike elasticity, i.e., the first layer was made of an ethylenevinyl acetate copolymer (having a vinyl acetate content of 10%), the second layer made of a vinylidene chloride-vinyl chloride copolymer composition which is prepared by mixing 2 parts by weight of epoxidized soy bean oil and 2 parts by weight of dioctyl adipate with 100 parts by weight of a vinylidene chloride-vinyl chloride copolymer containing 80% by weight of vinylidene chloride, and the third layer made of plasticized polyvinyl chloride containing 35 wt % of poly(butanediol adipate) of average molecular weight of 1,600. Three extruders were used to make each laminated film of the above-mentioned type by extruding each of the three starting materials into a common circular die from each of three flowing paths. Then, the three-layered parison of a cylindrical form in a molten state was treated by a so-called inflation technique in which air was injected into the molten parison beneath the die thereby producing a three-layered film having a first layer in thickness of 20μ, a second layer in thickness of 20μ, and a third layer in thickness of 40μ. In Table 1, there are shown the yield stresses at 90° C., the elongations at elastic limit, the elastic recovery rates after 40% uniaxial stretching, yield stresses at a normal temperature of 23° C. of the three-layered film and the individual layers.

Further, a rigid sheet of polyvinyl chloride was used as a base film, which was of 250μ in thickness and had been coated with a hot-melt adhesive composed of 100 parts by weight of a copolymer of ethylene and vinyl acetate having 40% by weight of vinyl acetate, 25 parts by weight of hydrogenated rosin glycerol ester, and 10 parts by weight of microcrystalline wax, the rigid sheet having a plurality of small holes in appropriate positions for the passage of air.

The vacuum packaging of a sliced sausage product of a cylindrical form of 10 cm in diameter and 2 cm in height was carried out using the above-mentioned packaging materials as follows, the description referring to FIG. 1:

At first, in step (a), the above-mentioned three layered film 5 was fitted to the lower end of the upper vacuum chamber 1 of 12 cm in diameter and 3 cm in height by applying a slight vacuum in the chamber 1. Then an electric current was applied on the wall of the chamber 1 and the heat plate 2 to bring the temperature to 90° C. with the simultaneous application of vacuum in the chamber 1 and with the lifted heat plate 2 upward. By this procedure, the layered film 5 was thermally deformed to have cup-shaped hollows on its surface within and following the shape of a metal mold consisted of the walls of the vacuum chamber 1 and the heat plate 2.

In the next step (b), the base film 6 was placed on the upper end of the lower vacuum chamber 3 and over the heat plate 4, the holes provided in the base film 6 being positioned between the periphery of the heat plate 4 and the inner side of the wall of the chamber 3.

In the step (c), each piece of the sausage product 7 was placed on the base film 6 in each position corresponding to each of the cup-shaped hollows in the layered film 5. Then in step (d), the upper vacuum chamber 1 was pulled down to meet the lower vacuum chamber 3 in order to bring the edge of the laminate film into contact with the edge of the base film 6 between the walls of both the vacuum chambers 1 and 3.

In steps (e) and (f), vacuum is applied to the spaces formed by the cup-shaped part of the laminate film 5 and the base film 6 each containing each piece of sausage product through the holes provided in the base film 6 from beneath the heat plate 4 of the lower vacuum chamber, with the simultaneous releasing the vacuum which had been applied in the space between the wall and the heat plate 2 in the upper vacuum chamber in step (a) to a normal level. By these steps, the part on the laminate film 1, which had been in the cup-shaped deformation now adhered to the piece of sausage product tightly with the contour of the piece, and in addition another part of the laminate film came into the holes in the base film 6 and solidified to close the holes when cooled. Finally, after cutting off the heating current and releasing the vacuum to normal level, the packaged sausage product within the laminated film and the base film was removed from the vacuum chamber. The appearance of the thus obtained packaging was very nice without any wrinkles.

The packaged sausages thus produced were not broken and were free from separation at the boundary of adhesion by shocks during transport and in handling. In addition, the package showed the so-called easy peelability, i.e., the shaped film and the base film were readily separable by hand uniformly along the hot melt adhesive face in a temperature range of 0°–40° C. Since the vinylidene chloride copolymer was used as the first layer of the laminated film, it was very excellent in preservability, i.e., the oxygen permeability of the film at 30° C. was as small as 30 ml/m$^2$.day.

The laminated film of the above-mentioned type could give stable and good packages when shaped at a mold temperature of 70°–100° C. Use of temperatures below 70° C. presented several disadvantages in that the first and second layers showed lower plastic deformation and could not counterbalance the elasticity of the third layer and, after cooling, the film was not suitably fixed in its shape because of high residual stress. As a consequence, the packaged ham was squeezed at its corners, and that a separation at the boundary between the three-layer film and the hot melt adhesive layer occurred since a separating force was exerted on the boundary due to the residual stress of the film. On the contrary, with mold temperature above 100° C., the film strength was reduced and, in some cases breakage of the film occurred upon the shape forming in the mold.

REFERENCE 1

The elastic third layer of Example 1 was replaced by a plastically deformable layer, i.e., the first layer was formed of the ethylene-vinyl acetate copolymer, the second layer formed of the vinylidene chloride-vinyl chloride copolymer, and the third layer formed of a zinc complex of ethylenemethacrylic acid copolymer (product of E. I. Du Pont de Nemours & Co., Inc., available under the designation of "Surlyne, Grade AD 8102").

Then, the procedure of packaging was carried out with the thickness of the film and the other arrangements as same as in Example 1. As a result, it was found that wrinkles were produced at any mold temperature and so good packages could not be obtained. The physical properties of the layers including the third layer are shown in Table 1. From Table 1, it is clearly seen that the elastic recovery rate of the film of the above type is as low as 63% when uniaxially stretched by 40% at 90° C., and thus wrinkles were produced due to an excessive permanent strain.

REFERENCE 2

The plasticized polyvinyl chloride which was used as third layer in Example 1 was singly used in Reference 2 and formed into a film of thickness in 80μ. Then, the packaging procedure was repeated as in Example 1. As a result, it was found that not only the corners of the packaged sausage were squeezed due to an excess of elasticity of the film, but also the rigid polyvinyl chloride sheet used as the base sheet was deformed.

In packaging, the film started to deform to tightly contact the sausage prior to the completion of evacuation of the space between the film and the sausage, i.e., before the difference in the degree of vacuum between the opposite sides of the film reached substantially zero. Thus, air could not be completely removed. In the case of the cylindrical package as in this Reference, the packaged sausage gave an unsightly appearance because of the air remaining in the upper portion of the package.

The film used had an elastic recovery percentage of 98% at 90° C. when uniaxially stretched by 40%.

EXAMPLE 2

As a resin layer with rubber-elasticity, a film made of a composition of 100 parts by weight of copolymer of vinylidene chloride and vinyl chloride containing 85% by weight of vinylidene chloride and 2 parts by weight of epoxidized soybean oil as a stabilizer, which had been biaxially stretched 3.5 times by a usual manner and having a thickness of 15μ was used. Two plastically deformable films (35μ in thickness) made of a sodium complex of a copolymer of ethylene and methacrylic acid (a product of E. I. Du Pont de Nemours & Co., Inc. available under the registered trade name of Surlyne, #1601) were laminated, respectively on both faces of the above-mentioned elastic film with a urethane adhesive to form a three-layered laminate. A base film was made by bonding a film of acrylonitrile-styrene copolymer having an acrylonitrile content of 75 wt % 10μ in thickness and a polypropylene film 200μ in thickness by means of a urethane adhesive. The hot melt adhesive used in Example 1 was applied onto the base film in the form of a circle concentrically with the circular sausage such that the adhesive circle was located at a distance of about 1 cm from the outer diameter of the circular sausage. Then, packaging was carried out in the same manner as in Example 1. As a result, a wrinkle-free sausage package with a nice appearance was obtained in a mold temperature range of 145°–155° C. Lower temperatures than 145° C. were found to be disadvantageous in that the sausage was compressed and deformed or its corners were squeezed due to the insufficiency in softness of the film. Higher temperatures than 155° C. were also disadvantageous in that the physical strength of the film was reduced and the film was readily broken on shaping in the mold.

The physical properties of the three-layer film and the respective layers including the yield stress at 150° C., the elongation at elastic limit, the elastic recovery rate, after 40% uniaxial stretching, the yield stress at a normal temperature (b 23° C.) are shown in Table 1.

EXAMPLE 3

Four extruders were used to make a laminated film including, from the outside, a first layer serving as a plastically deformable layer composed of a zinc complex of ethylene-methacrylic acid copolymer (product of E. I. Du Pont de Nemours & Co., Inc. available under the commercial name of Surlyne #1557), a second and a fourth layer both serving as adhesive layer and composed of styrene-isoprene block copolymer, a third layer as a plastically deformable layer composed of a terpolymer of vinylidene chloride, dodecyl acrylate and vinyl chloride (having a vinylidene chloride content of 82 wt % and a dodecyl acrylate content of 6 wt % and containing 2 wt % of epoxidized soybean oil), and a fifth layer as an elastic layer composed of 1,2-polybutadiene. These layers were combined in a circular die and air was blown, beneath the die, into the cylindrical five-layer parison in a molten state to form a bubble.

By this procedure, the respective layers were controlled to have the following thicknesses: first layer/-second layer/third layer/fourth layer/fifth layer=20μ/2μ/20μ/2μ/50μ. Thus, a plat film with a total thickness of 94μ was obtained. The thus obtained five-layered film and the same base film as in Example 1 were used for shape forming as in Example 1 for packaging. As a result, a wrinkle-free package with nice appearance was obtained at mold temperatures ranging from 60° to 90° C. With lower temperatures than 60° C., the film was too hard and squeezed the ham, while at temperatures higher than 90° C., the tensile strength of the polybutadiene layer was suddenly reduced and its inherent elasticity was lost, tending to produce wrinkles and, in some case, causing the film to break on the shape forming in the mold. The physical properties of the five-layered film and the respective layers including the yield stress at 70° C., the elongation at elastic limit, the elastic recovery rate after 40% uniaxial stretching, and the yield stress at a normal temperature (23° C.) are shown in Table 1.

higher than 70° C., the two films readily separated due to insufficiency in adhesion when laminated under non-pressure conditions. However, if a heat sealing device is provided just downstream of the shaping and packaging devices, a package standing practical use is obtainable. On the other hand, mold temperatures exceeding 100° C. were satisfactory for adhesion but, in some cases, caused the breaking of the film upon shape forming in the mold. A proper control of the mold temperature within the above-indicated range will give the so-called easy peelability or easy separability of the sealed package at the lower temperature level and give strong adhesion of the package at a higher temperature level.

TABLE 1

| | | | yield stress ($kg/cm^2$) | | elongation at elastic limit (%) | elastic recovery rate (%) |
|---|---|---|---|---|---|---|
| | | | at 23° C. | at shaping temp* | at shaping temp.* | 40% uniaxial stretching at shaping temp.* |
| Ex. 1 | first layer | plastically deformable layer | 60 | below 2 | below 10 | 70 |
| | second layer | plastically deformable layer | 300 | 20 | 20–25 | 60 |
| | third layer | elastic layer | — | — | over 50 | over 98 |
| | three layered film | | — | — | 25 | 85 |
| Ref. 1 | third layer | plastically deformable layer | 65 | below 2 | 15 | 70 |
| | three layered film | | 125 | 7 | 15–25 | 63 |
| Ex. 2 | | elastic layer | — | — | over 50 | over 98 |
| | | plastically deformable layer | 70 | below 1 | below 5 | (impossible to measure) |
| | three layered film | | — | — | over 50 | 94 |
| Ex. 3 | first layer | plastically deformable layer | 400 | 15 | 25 | 80 |
| | second layer | plastically deformable layer | 280 | 50 | 20–25 | 60 |
| | fifth layer | elastic layer | — | — | over 50 | over 98 |
| | five layered film | | 170 | 18 | 25–35 | 90 |

*Shaping temperature: 90° C. in Example 1 and References 1 and 2, 150° C. in Example 2, and 70° C. in Example 3.

EXAMPLE 4

Using a three-layered film in which the first layer with plastic deformation in Example 1 was substituted by a copolymer of ethylene and vinyl acetate (content of vinyl acetate of 20%) and the second and the third layers were of the same constitution as in Example 1 and also using the same three-layered film as the base film and after arranging the two films so that the opposing layers of each film were the ethylene-vinyl acetate layers, sausage was packaged as in Example 1. As a result, a stable wrinkle-free package was obtained at a temperature of 85° C.–100° C. Though the shape forming was possible even at temperatures lower than 85° C. but

EXAMPLE 5

A multi-layered film was produced in which the second layer was made from a 99.5% saponified copolymer of ethylene and vinyl acetate containing 68% of the vinyl acetate moiety and an adhesive layer of ethylene-vinyl acetate copolymer containing 20% vinyl acetate was inserted between the second and the third layers with respective thickness, after inflation, of 50, 5, 2 and 75 microns for the first, the second, the adhesive, and the third layer with the other conditions the same as in Example 1. The results obtained are illustrated in Table 2.

TABLE 2

| | | yield stress ($kg/cm^2$) | | elongation at elastic limit (%) | elastic recovery rate (%) |
|---|---|---|---|---|---|
| | | at 23° C. | at shaping temp.** | at shaping temp.** | 40% uniaxial stretching at shaping temp.** |
| first layer | plastically deformable layer | 60 | below 2 | below 10 | 70 |
| second layer | plastically deformable layer | 900 | 230 | below 10 | 38 |
| third layer | elastic layer | — | — | over 50 | over 98 |
| four-layered film | | — | — | 20–25 | 80 |

**Shaping temperature: 80° C.

The four-layered film and the same base sheet used in Example 1 were shape formed and used for packaging as in Example 1. As a result, a wrinkle-free package with a nice appearance was obtained at a mold temperature of 80°–110° C.

What is claimed is:

1. A method of vacuum packaging comprising the steps of:

(a) cup-shape-forming in a metal mold at a temperature of 50° to 180° C. under vacuum, a laminate film which is composed of (1) a plastically deformable layer of a synthetic resin having a yield stress larger than 50 $kg/cm^2$ at a temperature of 23° C. and an elongation of less than 30% at the elastic limit at the shaping temperature and (2) an elastic layer of a synthetic resin having an elongation of more than 40% at the elastic limit at said shaping temperature;

(b) placing a base film provided with a plurality of small holes for passage of air adjacent to the metal mold;

(c) placing articles or materials to be packed at positions on said base film corresponding to the cup-shaped hollows in said laminate film;

(d) bringing the flat edge part of said cup-shape formed laminate film into contact with the edge part of said base film;

(e) evacuating the interior of the spaces formed by the cup-shape hollows of said laminate film and said base film through said holes provided in said base film; and (f) releasing the vacuum which had been established in step (a) between said metal mold and said cup-shape formed laminate film thereby producing a tight package of said articles or materials having closely adhered laminate film, with tightly closed holes in said base film with said laminate film.

2. The method according to claim 1 in which the plastically deformable layer and/or the elastic layer of said laminated film are composed of a plurality of resinous layers.

3. The method according to claim 1, in which the total thickness of the plastically deformable layer of said laminate film is in the range of 3 to 100μ.

4. The method according to claim 1, in which the total thickness of the elastic layer of said laminated film is in the range of 10 to 100μ.

5. The method according to claim 1, in which the total thickness of the laminated film is in the range of 40 to 150μ.

6. The method according to claim 1, in which the plastically deformable layer of said laminated film comprises a first resinous layer highly impermeable to gases and a second resinous layer having a yield stress less than that of said first resinous layer at the shaping temperature.

7. The method according to claim 6, in which the second resinous layer serving as a plastically deformable layer of said laminated film has a yield stress less than 5 $kg/cm^2$ at said shaping temperature.

8. The method according to claim 1, in which the plastically deformable layer of said laminated film is formed of a resin which is readily plastically deformable at the shaping temperature by a stress which is less than $\frac{1}{3}$ of the yield stress of the film at a temperature of 23° C.

9. The method according to claim 8, in which the plastically deformable layer of said laminated film is formed of a resinous material which is easily deformable plastically by a stress below 10 $kg/cm^2$ at said shaping temperature.

10. The method according to claim 1, in which the laminated film has an elastic recovery rate of above 80% at said shaping temperature.

11. The method according to claim 1, in which the plastically deformable layer of said laminated film is composed of at least one resinous material selected from the group consisting of vinylidene chloride copolymer saponified ethylenevinyl acetate copolymers, and acrylonitrile resins.

12. The method according to claim 1, in which the elastic layer of said laminated film is composed of at least one resinous material selected from the group consisting of plasticized polyvinyl chloride, 1,2-polybutadiene and stretched and oriented vinylidene chloride-vinyl chloride copolymers.

13. The method according to claim 1 or 2, in which said shaping temperature is in the range of 70° to 150° C.

14. The method according to claim 1 or 2, in which said laminated film is shape-formed under a stress between the elastic limits of the plastically deformable layer and the elastic layer.

* * * * *